US005203358A

United States Patent [19]

Eytcheson

[11] Patent Number: 5,203,358

[45] Date of Patent: Apr. 20, 1993

[54] HAIR RINSING HOOD

[76] Inventor: Larry Eytcheson, 1900 Old State Rd. 67 West, Martinsville, Ind. 46151

[21] Appl. No.: 841,369

[22] Filed: Feb. 25, 1992

[51] Int. Cl.[5] ..... A45D 7/02

[52] U.S. Cl. ..... 132/212; 132/270; 2/174

[58] Field of Search ..... 132/212, 270, 333; 4/515, 516, 517, 520, 521; 2/174

[56] References Cited

U.S. PATENT DOCUMENTS

| | | | |
|---|---|---|---|
| 2,211,184 | 8/1940 | Varell | 2/174 |
| 2,600,557 | 6/1952 | Marriott | 2/174 |
| 2,647,264 | 8/1953 | Hutton | 2/174 |
| 2,684,072 | 7/1954 | Lewis | 132/212 |
| 3,040,336 | 6/1962 | Plank | 4/521 |
| 3,265,076 | 8/1966 | Ellis | 2/174 |
| 3,611,442 | 10/1971 | Yazaki | 2/174 |
| 3,929,143 | 12/1975 | Coleman | 2/174 |
| 3,996,946 | 12/1976 | Craig | 132/212 |
| 4,605,017 | 8/1986 | Thompson et al. | 132/333 |
| 5,099,865 | 3/1992 | Flannery et al. | 132/212 |

FOREIGN PATENT DOCUMENTS

| | | | |
|---|---|---|---|
| 122746 | 11/1946 | Australia | 132/333 |

*Primary Examiner*—Gene Mancene
*Assistant Examiner*—Frank A. LaViola
*Attorney, Agent, or Firm*—Woodard, Emhardt, Naughton, Moriarty & McNett

[57] ABSTRACT

A hair rinsing hood is provided that utilizes a sealable front access port and a discharge port to facilitate the rinsing of hair after the application of a permanent, hair coloring, shampoo, etc. The hood is collapsible so that it may be drawn close to the scalp to form a tight fitting cap about the head. The hood includes a trailing sheet which extends rearwardly and downwardly from the hood for conveying liquids to a drain.

12 Claims, 4 Drawing Sheets

HAIR RINSING HOOD

BACKGROUND OF THE INVENTION

The present invention relates generally to hair treatment aids and more particularly to protective hoods for use in rinsing the hair.

There are many processes associated with the grooming of human hair that require treating the hair with some type of liquid. Examples of such processes are applying solutions for a permanent, shampooing, and coloring. Because the types of liquids used in these processes can cause discomfort to the person requiring the treatment or can stain clothing, it is desirable to provide a means of isolating the scalp area from the face, neck and clothing of the person being treated.

The application of a permanent also requires Providing a means of retaining heat within the hair to activate the permanent solutions. In the past, a covering similar to a shower cap has been used in the application of permanent solutions to retain heat while the permanent is setting. These caps can, however, be messy and difficult to remove because they provide no means of rinsing the hair prior to removal. Furthermore, once the cap is removed, the client's head must be tilted rearward to a sink to rinse the hair. This can be difficult and uncomfortable for the client because the application of a permanent normally requires that heavy, bulky rollers be placed in the hair. The weight of these rollers and the fluid absorbed by the hair during the process can put a great strain on the client's neck if the client is required to lean backward.

There is also a need for an easy way of treating the hair of handicapped persons. Should a client be disabled or bedridden, it may be difficult or impossible to rinse the hair by having the client lean rearward toward a sink.

What is needed is a hair rinsing hood that provides protection of the facial, neck and clothing area of the client while at the same time providing for a neat and easy way of rinsing the hair without requiring the client to lean backward over a sink.

SUMMARY OF THE INVENTION

An improved hair rinsing hood according to one embodiment of the present invention comprises a flexible scalp covering including a pliable upper scalp covering portion, a pliable lower liquid directing portion sealingly connected to the upper scalp portion, an access port for the application of rinse water or other liquid, a discharge port located at the lower end of the lower liquid directing portion, and means for sealingly securing the enclosure about the head. Another feature of the present invention is a collapsible upper scalp covering portion that forms a tight fitting cap about the head.

Yet another feature of the present invention is a trailing sheet depending rearward and downward from the lower liquid directing portion for conveying liquids to a drain. A further feature of the present invention is means for opening and closing the access port thus providing rinsing access to the scalp.

It is an object of the present invention to provide an improved hair rinsing hood that may be sealingly secured about the head. Another object of the present invention is to provide a collapsible scalp covering that may be used to retain heat near the scalp.

A further object of the present invention is to provide a means of rinsing the hair which allows a client or patient to remain seated upright while the hair is rinsed. Related objects and advantages of the present invention will be apparent from the following description.

DESCRIPTION OF THE PREFERRED EMBODIMENTS

Figure 1:
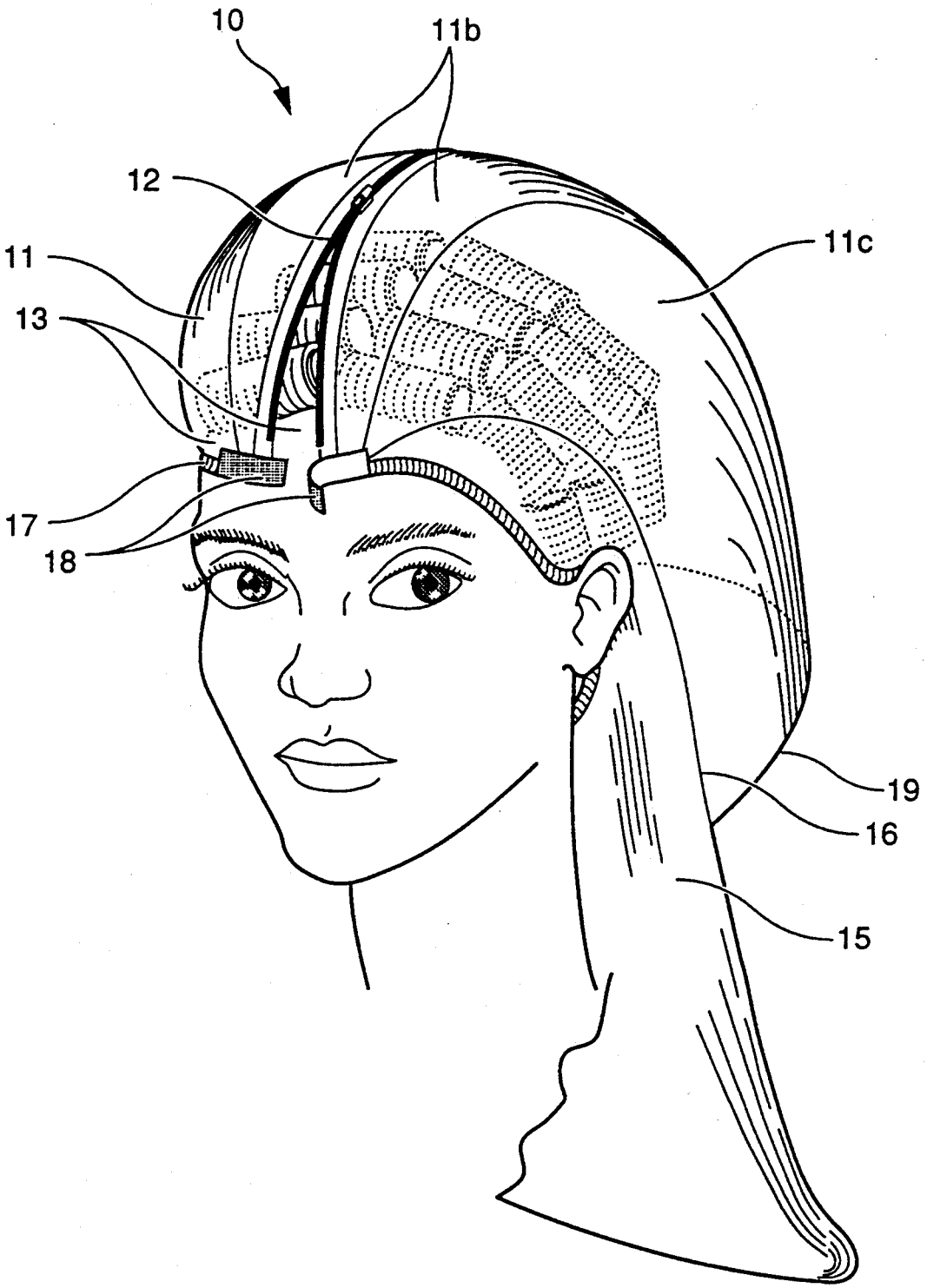
FIG. 1 is a front perspective view of the preferred embodiment of the hair rinsing hood incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
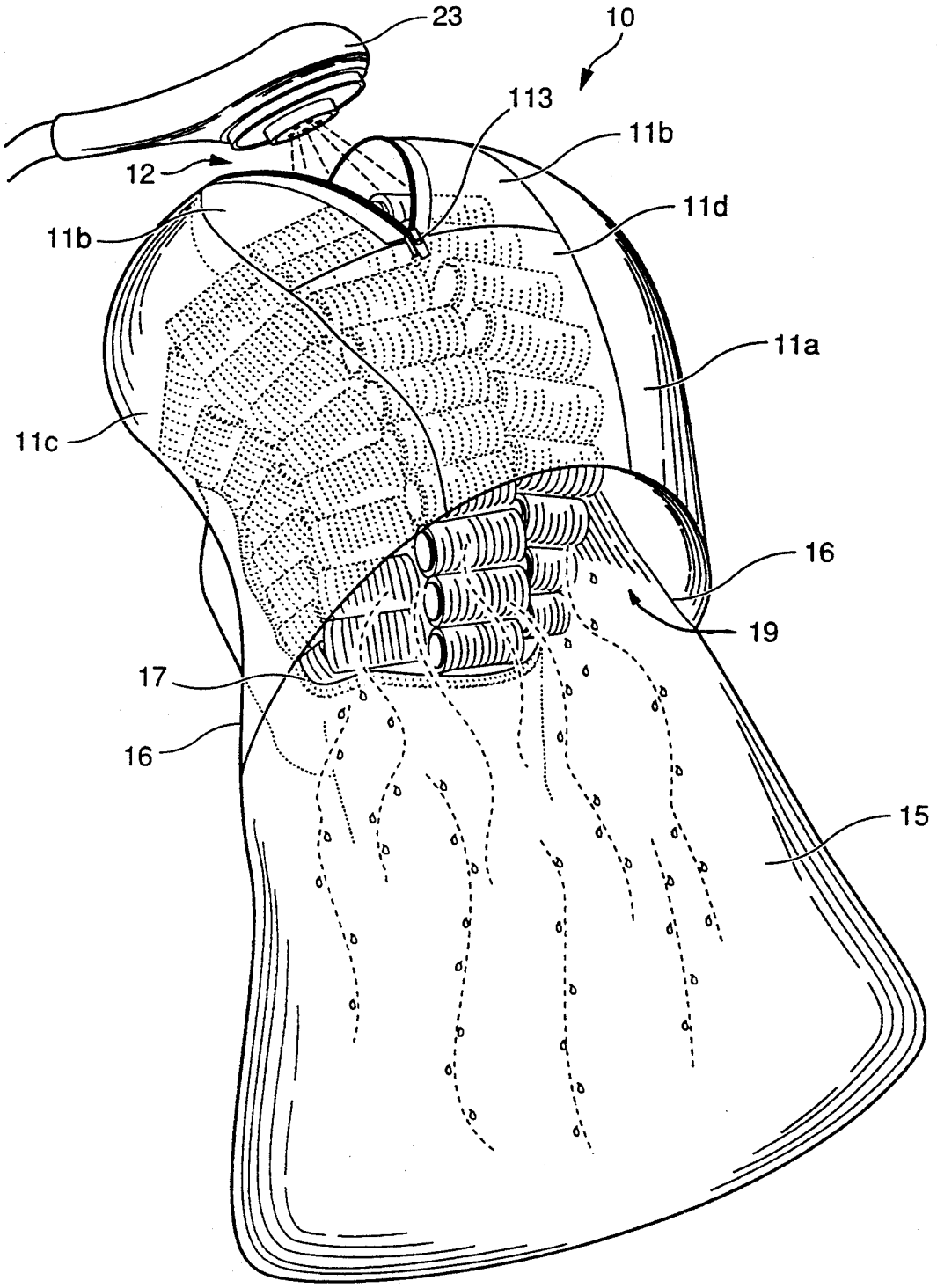
FIG. 2 is a rear perspective view of the hood of FIG. 1.

Referring to FIGS. 1 and 2 there is shown a hair rinsing hood 10 as it would appear after the application of a permanent solution or other liquid treatment, just prior to rinsing the hair. The upper portion of hair rinsing hood 10 consists of a four part scalp covering portion 11*a*–11*d* in one specific embodiment. Parts 11*a* and 11*c* form the side walls of the scalp covering portion. Part 11*b* has a zipper connected thereto and is shaped to form the upper front of the scalp covering portion. Part 11*d* forms the remainder of the scalp covering portion and is located at the upper rear of the scalp covering portion. The four parts 11*a* through 11*d* may be stitched, glued or heat sealed together so as to form a water impermeable barrier. It should be noted that scalp covering portions 11*a*–11*d* could also consist of a single piece form fitted and contoured to the head. This portion of the hood as well as the remaining components can be manufactured of any pliable water resistant material such as vinyl or other plastic.

At the upper front of scalp covering portion 11*b* is an access port 12. Access port 12 can be opened or closed to allow access to the scalp 13 from the front of client. In the preferred embodiment of the invention, a zipper 13 is provided for opening and closing access port 12. Zipper 13 can be made of nylon to prevent rusting or other adverse reactions with chemicals used in the hair treatment.

The use of a zipper in this manner allows for varying the size of the opening in access port 12. The hair stylist can open the zipper, insert a rinsing nozzle, and close the zipper around the nozzle to limit the amount of overspray. It should be noted that the invention also contemplates the use of two zipper slides for the opening wherein the slides would open in opposite directions allowing for more flexibility in the location of the opening.

Figure 3:
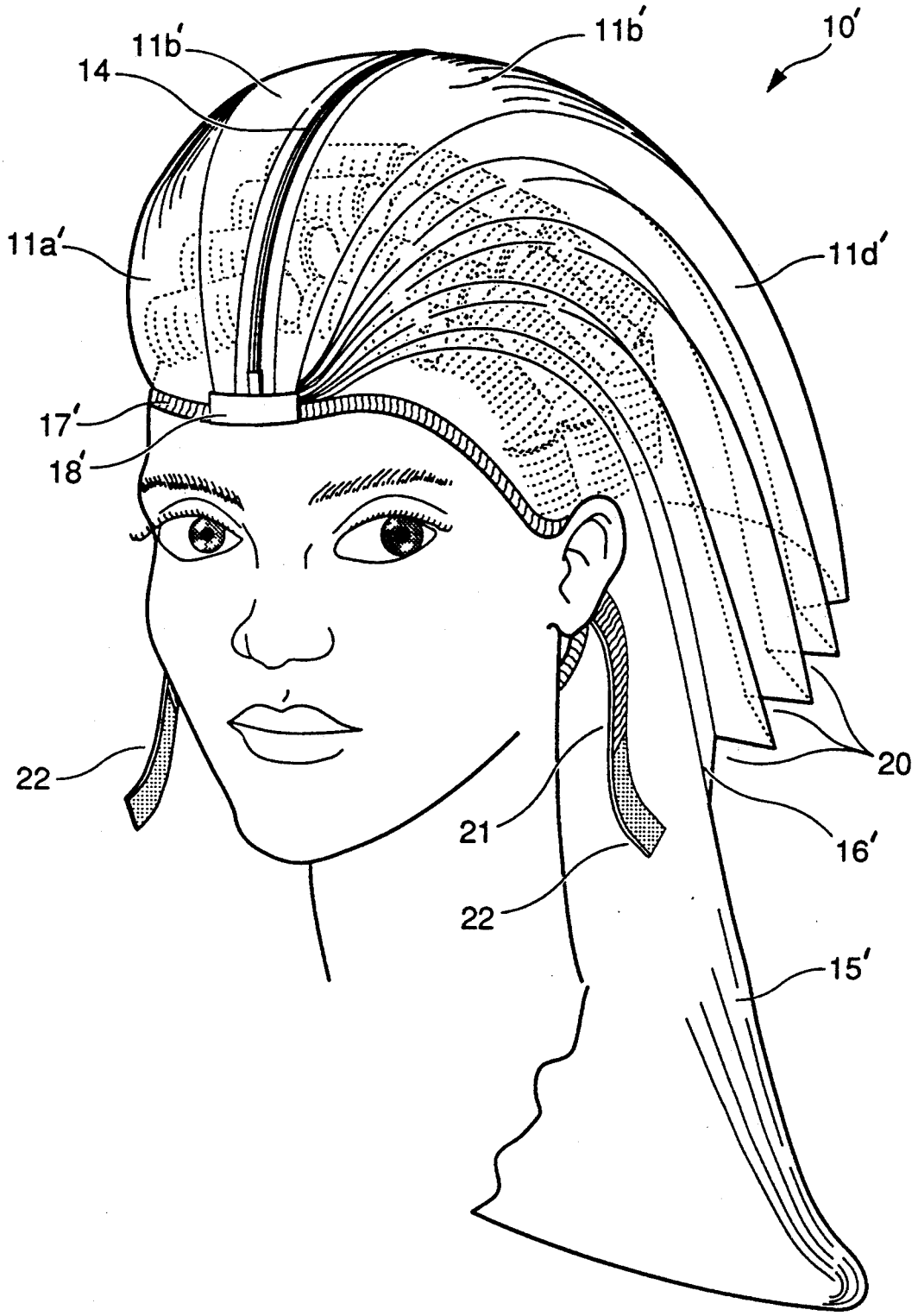
FIG. 3 is a front perspective view of an alternate embodiment of the hair rinsing hood incorporating the present invention.
Figure 4:
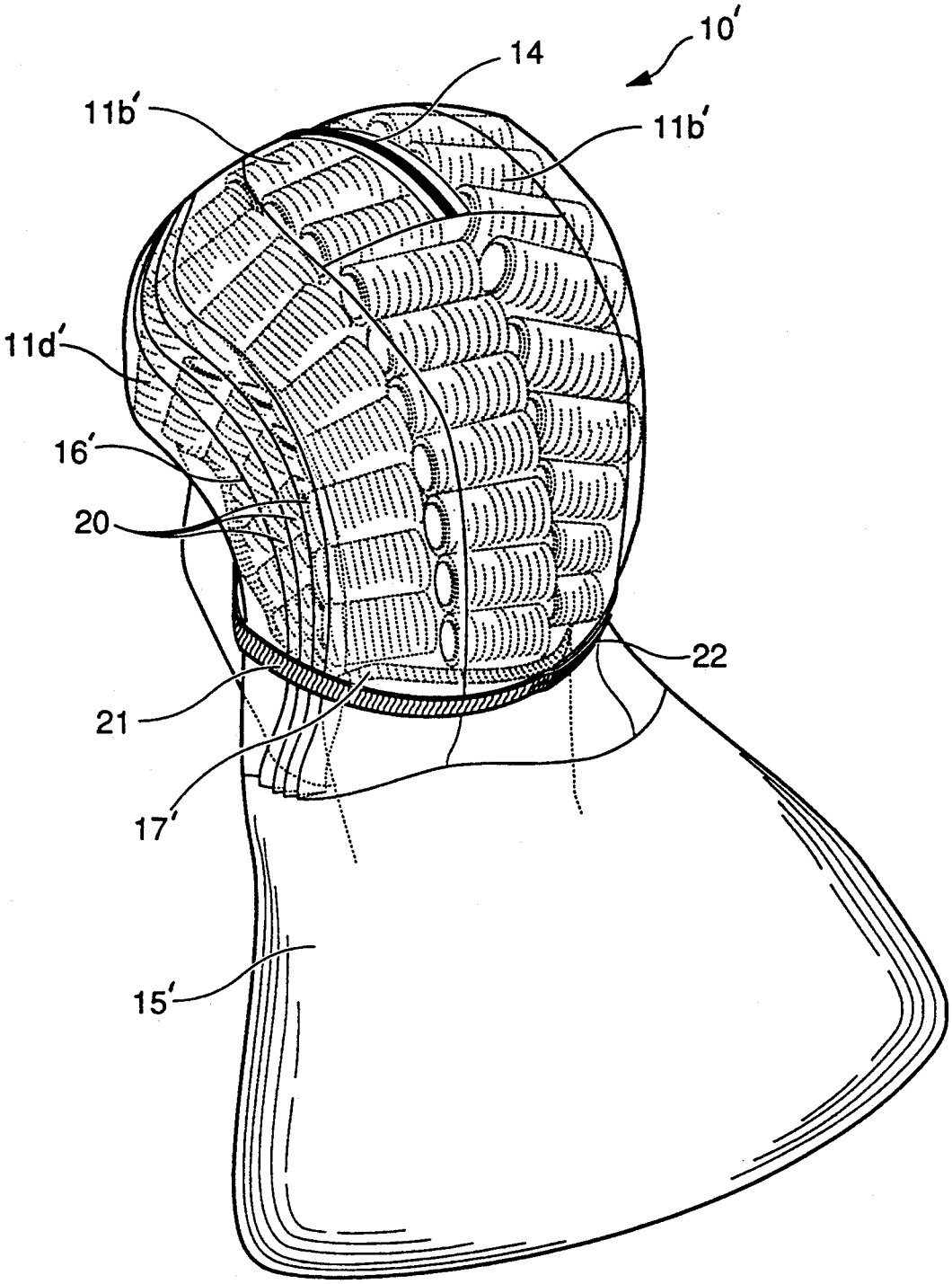
FIG. 4 is a rear perspective view of the hood of FIG. 3 depicting the invention as it appears when used as a heat barrier during the application of a hair permanent.

In an alternate embodiment of the invention shown in FIGS. 3 and 4, access port 12' is provided with an interlocking profile fastener 14 which would allow access port 12' to be opened or closed. Interlocking profile fastener 14 is comprised of male and female resilient interlocking components such as those used in resealable plastic bags. Fastener 14 can be made of plastic and can be integrally formed into or with scalp covering portion 11*b*. The use of such an interlocking profile fastener 14 would facilitate opening the access port at a specific location.

Scalp covering portions 11*a*, 11*b*, and 11*c* are sealingly connected at their outside edges to a fluid directing portion 15 by means of seams 16. These seams may be formed by heat sealing or stitching. If the seams are stitched, the use of polyester thread is recommended to avoid rotting. Likewise, polyester thread is recommended at all other areas that require stitching.

An elastic band 17 is disposed about the front pheriphery of fluid directing portion 15. The elastic band 17 provides a means of sealingly securing the enclosure about the head. In the preferred embodiment, hook and loop type fastener 18 is disposed at the front portion of the fluid directing portion 15. This adjustment mechanism allows for release of the elastic band to facilitate removal of the cap and for adjustment to fit a particular client's head.

Fluid directing portion 15 is essentially a sheet of pliable material that may be placed with one end of the sheet draping into a sink to convey rinse water runoff from the scalp area to a drain. It should be noted that rinse water could also be collected and deposited into a conduit connected to fluid directing portion 15 for conveyance into a drain.

Located at the rear of scalp covering portion 11 is a secondary access port 19 that provides rinsing access to the back portion of the client's head and scalp. Secondary access port 19 is shown in its open position in FIG. 1. Secondary access port 19 resembles the opening of a bag wherein scalp covering portions 11*a*–11*d* and fluid directing portion 15 form the sidewalls of the bag and the scalp 13 of the client forms the base. Secondary access port 19 may be closed by drawing upper scalp covering portion 11 downwardly near the rear edge. Configuring the hood in a this manner prevents rinse water spray that has entered the hood through access port 12 from being jettisoned out the rear of the hood. Also, arranging the hood in this manner causes rinse water to be deflected downwardly toward fluid directing portion 15.

An alternate embodiment of the invention is shown in FIGS. 3 and 4. The alternate embodiment has many similar features of the previously described embodiment. Such similar features are labeled as 11' for an element similar to 11, etc. In the alternate embodiment, scalp covering portion 11' is provided with pleats 20 which facilitate folding scalp covering portion 11' tightly over the scalp. Configuring the hood in this manner allows heat to be retained during the application of the permanent solution or other treatment. FIG. 4 illustrates hair rinsing hood secured in a heat retaining configuration by a second elastic elastic band 21 and a second hook and loop fastener 22. The second hook and loop fastener 22 may be released after application of the permanent solution or other treatment to allow for rinsing of the scalp in a manner similar to that described above.

The present invention is particularly useful in the application of a permanent. The client's hair is first pretreated and rolled with curlers. Next, hair rinsing hood 10 is secured about the scalp and is adjusted to form a tight seal by manipulating the hook and loop fastener 18. Hair treatment chemicals are then applied to the hair via access port 12 and secondary access port 19. Secondary access port 19 also provides the beautician with access to the scalp so that the beautician may use his or her hands to massage the scalp and fully introduce the treatment. Scalp portion 11*a*–11*d* is then folded downwardly so as to form a tight seal with the scalp and secured with secondary hook and loop fastener 22.

After the passage of a designated period of time which for the particular treatment such as may be required for setting of the permanent, secondary hook and loop fastener 22 is released and scalp covering portion 11 is moved upwardly. Access port 12 is then opened and a spray rinser 23 is used to rinse the hair treatment chemicals out of the hair near the front portion of the scalp. The rinsing fluid and the chemicals flow along the scalp toward the rear of hair rinsing hood 10 and are conveyed by fluid directing portion 15 toward a drain.

Once the front portion of the scalp is sufficiently rinsed, access port 12 is closed and secondary access port 19 is opened so as to provide access to the rear portion of the scalp. A rinsing spray is then applied to the rear portion of the scalp by way of secondary access port 19. The rinse water and hair treatment chemicals are collected near the bottom of hair rinsing hood 10 and are conveyed toward a drain via fluid directing portion 15. After the scalp is sufficiently rinsed it may be shampooed with hair rinsing hood 10 in place by using the access port 12 and secondary access port 14.

It should be noted that fluid directing portion 15 may be relatively rigid in the form of a scoop to control the flow of water. Fluid directing portion 15 may also be long enough so as that the client may remain seated upright while the hair is rinsed. The client is, therefore, subjected to much less stress and strain during the entire procedure because he or she may be able to remain seated in an upright position. It should also be noted that the entire hair rinsing hood can be formed of multiple pieces connected together or can be formed of one sheet folded over and attached with a zipper opening cut in the front.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A flexible hood for use in washing hair and retaining heat during a permanent inducing process comprising:

a flexible scalp covering including;

a pliable upper scalp covering portion having a first expanded state to permit access to the scalp and collapsible to a second state tightly about the scalp to form a heat retaining barrier;

a pliable lower liquid directing portion, sealingly connected to said upper scalp covering portion, and having a lower end;

a front port for the application of a liquid and having front access control means for opening and closing said front port;

a rear port located at said lower end of said lower liquid directing portion said rear port having rear access control means for opening and closing said rear port; and sealing means for sealingly securing said flexible scalp covering about the head.

2. The hood of claim 1 wherein said upper scalp covering portion includes collapsing means for drawing said upper portion into said second state close to substantially all of the scalp to form a tight fitting cap about the head.

3. The hood of claim 2 wherein said collapsing means includes pleats formed in said upper portion said pleats running along substantially the entire length of said upper portion.

4. The hood of claim 3 wherein said collapsing means includes a band fixed to said scalp covering adjacent to the base of the scalp to secure said pleated upper portion tightly about the head.

5. The hood of claim 4 wherein said band is elastic.

6. The hood of claim 4 wherein said band is comprised of two pieces having hook and loop fastening means between said two pieces.

7. The hood of claim 1 wherein said lower liquid directing portion includes a trailing sheet depending rearward and downward from said upper portion for conveying collected liquids to a drain.

8. The hood of claim 1 wherein said front access control means is a zipper.

9. The hood of claim 1 wherein said front access control means is an elongated interlocking profile fastener wherein said interlocking profile fastener may be opened at any point along its length.

10. The hood of claim 1 wherein said sealing means includes an elastic band disposed along the bottom of the hood.

11. The hood of claim 10 wherein said elastic band also has a hook and loop adjustment means.

12. The hood of claim 1 wherein said flexible scalp covering is made of of vinyl.

* * * * *